US009125266B2

(12) United States Patent
Welten et al.

(10) Patent No.: US 9,125,266 B2
(45) Date of Patent: Sep. 1, 2015

(54) LED DRIVER OPERATING IN BOUNDARY CONDITION MODE

(75) Inventors: Petrus Johannes Maria Welten, Oss (NL); Kevin Lambertus Hubertus Salden, AR Einighausen (NL)

(73) Assignee: ELDOLAB HOLDING B.V., Son En Breugel (NL)

( * ) Notice: Subject to any disclaimer, the term of this patent is extended or adjusted under 35 U.S.C. 154(b) by 514 days.

(21) Appl. No.: 13/637,270

(22) PCT Filed: Mar. 24, 2011

(86) PCT No.: PCT/NL2011/050203
§ 371 (c)(1),
(2), (4) Date: Sep. 25, 2012

(87) PCT Pub. No.: WO2011/119031
PCT Pub. Date: Sep. 29, 2011

(65) Prior Publication Data

US 2013/0020958 A1 Jan. 24, 2013

(30) Foreign Application Priority Data

Mar. 25, 2010 (NL) ..... 2004458

(51) Int. Cl.
*H05B 37/02* (2006.01)
*H05B 33/08* (2006.01)

(52) U.S. Cl.
CPC ..... *H05B 33/0818* (2013.01)

(58) Field of Classification Search
USPC ..... 315/210–211, 215–217, 297
See application file for complete search history.

(56) References Cited

U.S. PATENT DOCUMENTS

| | | | | |
|---|---|---|---|---|
| 8,305,004 | B2 * | 11/2012 | Shao | 315/247 |
| 2007/0267978 | A1 | 11/2007 | Shteynberg et al. | |
| 2008/0150877 | A1 * | 6/2008 | Chao et al. | 345/102 |
| 2009/0284178 | A1 * | 11/2009 | Jessenig et al. | 315/297 |
| 2009/0295776 | A1 * | 12/2009 | Yu et al. | 345/212 |

FOREIGN PATENT DOCUMENTS

| | | | |
|---|---|---|---|
| WO | 2007049198 | A1 | 5/2007 |
| WO | 2010004475 | A1 | 1/2010 |

* cited by examiner

*Primary Examiner* — Douglas W Owens
*Assistant Examiner* — James H Cho
(74) *Attorney, Agent, or Firm* — Browdy and Neimark, PLLC

(57) ABSTRACT

An LED driver for controlling a current supplied to an LED fixture, the LED driver including a switched mode power supply (SMPS) for providing the current to the LED array and a control unit for controlling a switch of the SMPS. The control unit includes an input terminal connected to a current sensing circuit and the switch is connected to the LED fixture at a node downstream of the LED fixture. The current sensing circuit of the LED driver provides a feedback signal to the input terminal of the control unit; the current sensing circuit including a current sensor arranged to provide, when the switch is closed, the feedback signal representing a level of the current supplied to the LED fixture; the current sensing circuit further providing the feedback signal indicating a zero-crossing of the current supplied to the LED fixture when the switch is open.

18 Claims, 8 Drawing Sheets

LED DRIVER OPERATING IN BOUNDARY CONDITION MODE

BACKGROUND ART

LED based illumination is at present more and more applied instead of conventional lighting such as halogen lights.

In general, LED based illumination applications comprise an LED fixture (e.g. comprising one or more LEDs) and an LED driver for powering the LED fixture. Such an LED driver, in general, comprises a power converter (e.g. a switched mode power converter such as a Buck or Boost converter) and a control unit controlling the power converter and thus the current as supplied to the LED fixture. The power converter of an LED driver for LED based applications is often operated at a comparatively high switching frequency (~100 kHz or more) and provides as such a substantially continuous current to the LED fixture. However, a more efficient way to supply a current to an LED fixture may be to operate the power converter of the LED driver in a so-called boundary conduction mode (also known as critical condition mode) whereby a switch of the power converter is switched off at a predetermined level (e.g. determined from a set-point indicating a desired illumination characteristic), and switched on again at a zero-crossing of the current. Such an operating mode is e.g. described in US 2007/0267978. By operating the power converter in a critical conduction mode, less dissipation occurs in the switch or switches of the power converter, providing an improved overall efficiency. In order to determine at which current level the power converter is operating, the LED drivers as known in the art are provided with several current or voltage sensors providing feedback signals to a control circuit controlling the power converter. Such sensors in general provide their feedback signals to a plurality of input terminals of the control unit thus putting constraints to the complexity of the control unit or limiting the functionality of the control unit. As typically such control units are bought as separate components whereby only a limited number of configurations are available (e.g. with respect to the available in- or outputs), such a sensor feedback requirement may limit the choice of selecting a general purpose control unit or may require purchasing a more extended, thus more expensive control unit.

SUMMARY OF THE INVENTION

According to an aspect of the invention, there is provided an LED driver for providing a current to an LED fixture comprising at least one LED, the LED driver comprising:

- A switched mode power supply (SMPS) for providing the current to the LED fixture, the SMPS comprising a first, high voltage terminal and a second, low voltage terminal for, in use, receiving the LED fixture; the SMPS comprising a first capacitance for, in use, bridging the LED fixture, and a switch, connected at the second terminal, downstream of the LED fixture;
- A control unit for controlling the switch of the SMPS based on a feedback signal received at an input terminal of the control unit;
- A current sensing circuit arranged to provide the feedback signal to the input terminal of the control unit; the current sensing circuit comprising a second capacitance connecting the second terminal and the input terminal for providing the feedback signal when the switch is open; the current sensing circuit further comprising a current sensor arranged to provide, when the switch is closed, the feedback signal representing a level of the current supplied to the LED fixture by connecting the current sensor to the input terminal via a further switch, the further switch being controlled by the control unit;

The present invention provides in an LED driver for powering an LED fixture by a current supplied by an SMPS such as a Buck or Boost converter.

SMPS in general comprises a switch and an inductance as an energy storage element. The inductance can be a single inductance or can be part of a set of magnetically coupled inductances. The inductance may also take the form of a winding of a transformer. Further, an SMPS is in general provided with a so-called freewheeling path for the current. Such a freewheeling path can be provided with a freewheeling diode or, as an alternative, with a controllable switch such as a MOSFET. The LED driver according to the invention is particularly suited for powering the LED fixture in so-called boundary condition mode (BCM), also referred to as critical condition mode, whereby an on-switching of a switch of the SMPS occurs when the current as provided by the SMPS is substantially zero. In accordance with the invention, the switching of the SMPS's switch is controlled by a control unit such as a microcontroller, microprocessor, Field Programmable Array or the like. In order to provide a feedback signal to a control unit of the LED driver which represents such a substantially zero-current situation, also referred to as a zero-crossing instance, state of the art LED drivers require additional input terminals or ports on the control unit of the LED driver. In the LED driver according to the present invention, a single input is sufficient to provide the feedback signal providing both an indication of the supply current when the switch of the SMPS is closed and an indication of the occurrence of a zero-crossing instance. As such, the LED driver according to the present invention can be provided with a control unit having less input terminals (thus simplifying the control unit resulting in an advantage with respect to costs and/or robustness) or, as an alternative, the available input terminals can be applied for other purposes, thus increasing the functionality of the LED driver.

In accordance with the invention, the LED driver comprises a first, comparatively high voltage terminal and a second, comparatively low voltage terminal for, in use, receiving an LED fixture. Such an LED fixture can e.g. comprise a plurality of LEDs, arranged in series, parallel or a combination thereof.

In accordance with the present invention, the LED fixture can be connected directly between the first and second terminal or indirectly. In the latter case, the first and second terminal can e.g. be bridged by an inductance forming a first, primary winding of a transformer, whereas a secondary winding of the transformer is, in use, applied to receive the LED fixture. In such case, the LED fixture is thus magnetically connected between the first and second terminal.

The LED driver according to the invention comprises a first capacitance for in use bridging the LED fixture. In an embodiment, the capacitance is connected between the first and second terminal. As will be explained in more detail below, the application of such a capacitance enables the provision of a feedback signal indicating a zero-crossing of the current provided by the SMPS.

In use, the high voltage terminal can e.g. be connected to a supply voltage such as a rectified mains voltage via an inductance of the SMPS; the low voltage terminal can e.g. be connected to ground, e.g. via the switch of the SMPS.

In accordance with the invention, the LED driver is provided with a current sensing circuit which comprises a current sensor (e.g. a resistance) arranged to provide, when the switch is closed, a feedback signal representing a level of the current supplied to the LED fixture.

In an embodiment, the current sensor is connected in series with the switch of the SMPS. As such, when the switch is closed, the sensor can provide a signal representing the actual value of the current as a feedback signal to the control unit. By applying the sensor in series with the switch, dissipation in the current sensor can be reduced as the current sensor is not provided with a current when the switch is open. As a consequence however, the current as provided to the LED fixture during the time the switch is open (said current e.g. being provided via a freewheeling current path of the SMPS), is not sensed by the current sensor. In order to provide a feedback signal representing the SMPS current when the switch is open, conventional LED drivers often apply additional sensors (e.g. resistors) in the freewheeling path. Such sensors may add to the overall dissipation of the LED driver and thus adversely affect the efficiency and may require the control unit to have an additional input terminal for receiving a feedback signal from the sensor.

In accordance with the present invention, the current sensing circuit is further provided with a capacitance connecting the second terminal and the input terminal of the control unit which receives the feedback signal. By doing so, a feedback signal can be provided even when the switch is open.

In the LED driver according to the invention, the capacitance connecting the second terminal and the input terminal, combined with a capacitance bridging the LED fixture, e.g. provided between the first and second terminal, enables the provision of a feedback signal to the control unit substantially indicating a zero-crossing of the current as supplied by the SMPS. These and other aspects of the invention will be more readily appreciated as the same becomes better understood by reference to the following detailed description and considered in connection with the accompanying drawings in which like reference symbols designate like parts.

BRIEF DESCRIPTION OF THE DRAWINGS

In FIG. 1, the following components of an LED based lighting application can be identified:

Figure 1:
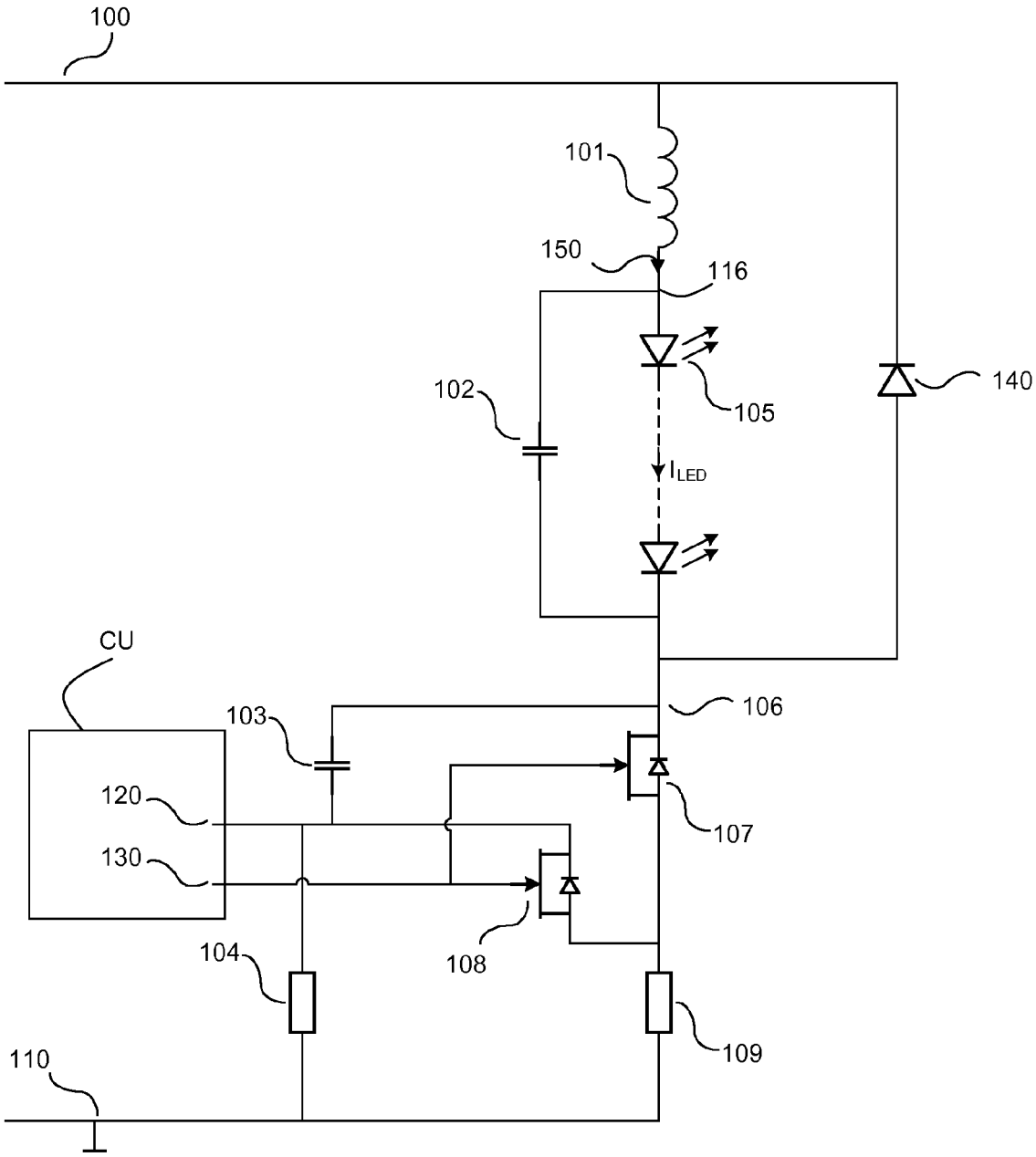
FIG. 1 schematically depicts an LED based lighting application powered by a first embodiment of an LED driver according to the invention.

an LED fixture comprising an array of LEDs 105, the LED fixture being arranged between a first terminal 116 and a second terminal 106 of an SMPS;

an LED driver comprising

- a switched mode power supply (SMPS) comprising an inductance 101 connected to a supply voltage 100, a switch 107, a freewheeling diode 140 and a capacitance 102 bridging the LED fixture;
- a control unit CU having an input terminal 120 for receiving a feedback signal and an output terminal 130 for providing a control signal controlling the switch 107 of the SMPS.

In the embodiment as shown, the LED fixture (comprising the array of LEDs 105) is connected between first terminal 116 and second terminal 106, the first terminal during use being at a higher voltage compared to the second terminal. The LED driver further comprises a current sensing circuit comprising a current sensor (resistor 109) which is connected in series with the switch 107, outside the freewheeling current path as provided by the freewheeling diode 140. The current sensing circuit also comprises a further switch 108. When this switch 108 is closed, the voltage over current sensor 109 can be provided as a feedback signal to terminal 120 of the control unit CU. Opening and closing of the switch 108 can be controlled by the control unit CU, e.g. in synchronism with the operating of switch 107. When switch 107 is closed, the current through inductance 101 also flows through switch 107 and current sensor 109. In the arrangement as shown, the switch 107 is provided downstream of the LED fixture (with respect to the supply voltage 100). As such, the switch 107 remains at a comparatively low voltage, enabling the switch to be controlled by a comparatively low control signal. Providing the switch 107 upstream of the LED fixture, as is often found in conventional LED drivers, would in general require a voltage level shift of the control signal as provided at terminal 130 to a suitable level for controlling the switch 107. In particular in high voltage applications (e.g. applications whereby the supply voltage is a rectified mains voltage), such a voltage level shift would add to the complexity and dissipation of the LED driver.

In the arrangement as shown, the current sensing circuit further comprises a capacitance 103 connecting the second terminal (or node) 106 downstream of the LED fixture with the input terminal 120. As will be explained in more detail below, the application of capacitance 102 and capacitance 103 enable the provision of a feedback signal to terminal 120 (i.e. the same terminal that receives the feedback signal from current sensor 109) indicating a zero-crossing of the current supplied by the SMPS. Upon receipt of such a feedback signal, the control unit CU can provide a control signal to switch 107 in order to close the switch. By switching the switch from an off-state to an on-state at an instance when the current through the switch is substantially equal to zero, switching losses are reduced. When switches 107 and 108 are closed (the control signal provided at terminal 130 can be applied, as shown in FIG. 1, to control both switches in synchronism), a voltage across current sensor 109 (e.g. a resistor) can represent the actual current as supplied by inductance 101. As such, this voltage can be applied as a feedback signal to the input terminal 120 of the control unit CU. Based upon this signal, the control unit CU can determine when to open switch 107 again, e.g. when the feedback signal reaches a specific value, (e.g. derived from a set-point representing a desired illumination characteristic). As such, the LED driver according to the invention enables to provide a current in boundary condition mode (or critical condition mode) to an LED fixture using a single input terminal for receiving a feedback signal. When operating in boundary condition mode, the current as provided by the SMPS varies between a maximum value and zero, having an average value substantially equal to half the maximum value. It is worth noting that, the application of capacitance 102 as indicated above, enables a reduction of the variation of the current as provided to the LED fixture. As such, the capacitance 102 also operates as a smoothing capacitance 102.

Figure 2:
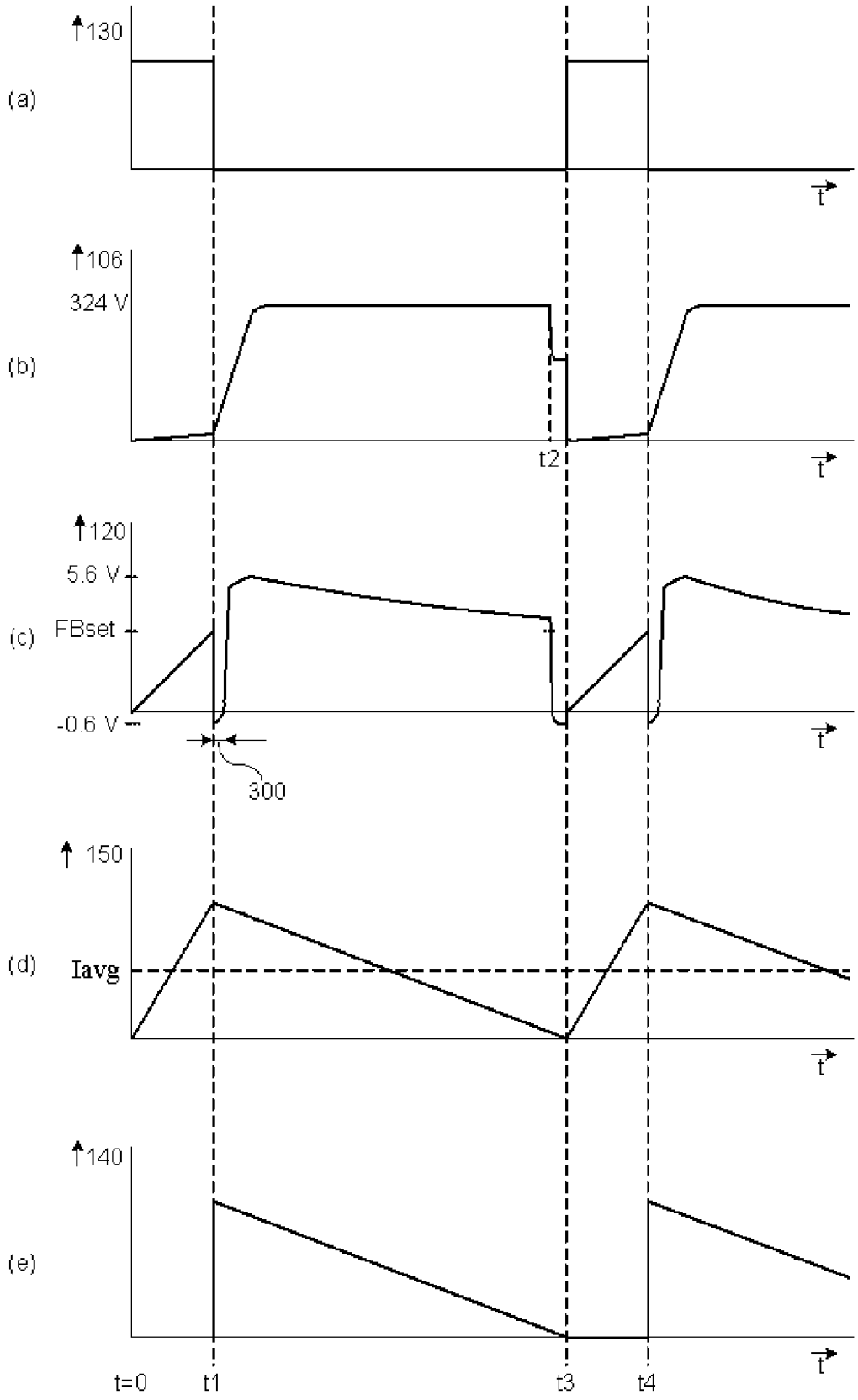
FIG. 2 schematically depicts various current and voltage waveforms as occurring during operation of the LED driver.

The operation of the LED driver as schematically depicted in FIG. 1 is explained in more detail in FIG. 2, schematically depicting the following signals as a function of time t:

- graph (a): the control signal provided at terminal 130 controlling the switches 107 and 108;
- graph (b): the voltage at node 106;
- graph (c): the feedback signal as provided by the current sensing circuit to terminal 120 and
- graph (d): the current 150 as provided by the SMPS.
- graph (e): the current through the freewheeling path (i.e. through diode 140) of the SMPS.

In graph (a) of FIG. 2, the control signal as provided by the control unit CU at terminal 130 is schematically depicted. When the signal is high, switches 107 and 108 are assumed to be closed. Correspondingly, the current as provided by the SMPS (shown in graph (d)) will increase when switch 107 is closed, and will decrease (the current will flow via freewheeling diode 140) when switch 107 is open. At t=0, the current as provided by the SMPS (as shown in graph (d)) is assumed to be zero whereupon the switch 107 is closed, resulting in the current starting to increase. By closing switch 108 at the same time, the voltage across resistor 109 is applied as feedback signal at input terminal 120, said voltage increasing proportional to the current, as shown in graph (c), said graph schematically depicting the signal at terminal 120. At t=t1, the control unit CU determines, based on the feedback signal at terminal 120, (i.e. the feedback signal having a value equal to FBset, which can e.g. be determined by the control unit based on that the current is sufficiently high and switches 107 and 108 are opened). As a result, the voltage at node 106 (graph (b)) rapidly increases towards the supply voltage level minus the voltage drop over the freewheeling diode 140, as the latter start conducting. The opening of switches 107 and 108 may result in a momentary drop in the feedback signal (indicated by interval 300 in graph (c)), the signal however rapidly recovers due to the charging of capacitance 103 via an impedance 104, e.g. a resistor. Depending on the dimensioning of the circuit, e.g. the switching circuits of the switches 107 and 108, a brief oscillation or another transient phenomenon may occur as well in the interval 300. In order to ensure that the control unit is not triggered by such a momentary drop or transient, the control unit can be programmed to ignore, during a predetermined period following an opening of the switches 107 and 108, the feedback signal. As an alternative, the voltage drop can be eliminated through electronic means and/or proper dimensioning of the current sensing circuit. The opening of switches 107 an 108 further results in the current through the LED fixture to flow through the freewheeling diode 140, as schematically shown in graph (e).

Due to the charging of capacitance 103, the feedback signal thus remains high (despite the fact that the current sensor 109 is no longer connected to the terminal 120) and the control signal 130 remains low (i.e. switches 107 and 108 remain open). Due to the opening of switch 107, the current 150 as provided by the SMPS (graph (d)) will gradually decrease until it reaches zero. When the current reaches zero, the LEDs of the LED array and the freewheeling diode 140 will cease to conduct and the voltage at node 106 will drop (indicated at instance t2) due to the voltage available over capacitance 102. This voltage drop will equally cause the feedback signal (via capacitance 103) to drop as indicated. The feedback signal will therefore drop below the FBset value thus providing an indication that the current as supplied is insufficient. This indication occurs, as shown, substantially when a zero-crossing of the current occurs. Based on this signal, the control unit can derive the occurrence of a zero-crossing of the current and can provide a control signal to the switches 107 and 108 to close them again. Once the switches are closed, capacitance 103 can discharge such that it can be charged again during a next cycle, thus again providing the required feedback signal.

In an embodiment, the control signal controlling the closing of 107 and 108 may be delayed relative to the instance indicating the zero-crossing of the current. By doing so, the LED driver can be operated in discontinuous mode. In an embodiment, the delay is a fixed predetermined value. As an alternative, the delay can be made adjustable.

With respect to the feedback signal as applied to the control unit, it is worth mentioning that, in order to avoid an excessive voltage occurring at the input terminal, the feedback signal can e.g. be clamped e.g. between a series connection of two diodes connected between a comparatively low voltage (e.g. 5 V) and ground. Such clamping diodes can e.g. be comprised in the control unit.

As such, the current sensing circuit of the LED driver according to the invention enables a control unit to control an SMPS from a feedback signal received at a single input terminal instead of requiring multiple feedback signals at multiple input terminals.

The LED driver according to the invention thus enables an automatic switching of an SMPS at a zero-crossing of the current provided by the SMPS enabling the LED driver to operate in a boundary condition mode (or critical condition mode) in an easy manner. The LED driver according to the invention can be implemented to power an LED fixture in an LED based lighting application according to the invention.

Figure 3:
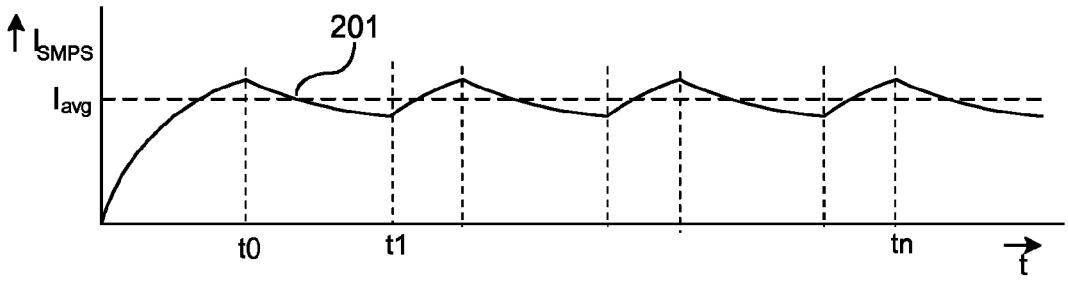
FIG. 3 schematically depicts a current waveform as provided by conventional LED drivers.

In a conventional LED driver, an SMPS switch is operated at a comparatively high frequency in order to obtain a substantially constant level of the current that is supplied to the LED fixture. In FIG. 3, such a current profile is schematically depicted. By opening and closing a switch of an SMPS at instances t0 . . . tn, the SMPS can provide a current $I_{SMPS}$ having a current profile 210, having an average value $I_{avg}$. As a comparatively high switching frequency needs to be applied whereby the on-switching occurs under non-zero current conditions, the switching losses can be considerable, adversely affecting the overall efficiency of the application. In the LED based lighting application according to the invention, the capacitance as provided between the first and second terminal of the LED fixture enables smoothing the current $I_{LED}$ that flows through the LED or LEDs of the LED fixture. As such, a comparatively smooth current through the LED or LEDs of the assembly can be obtained, substantially without the comparatively high switching losses.

Figure 4:
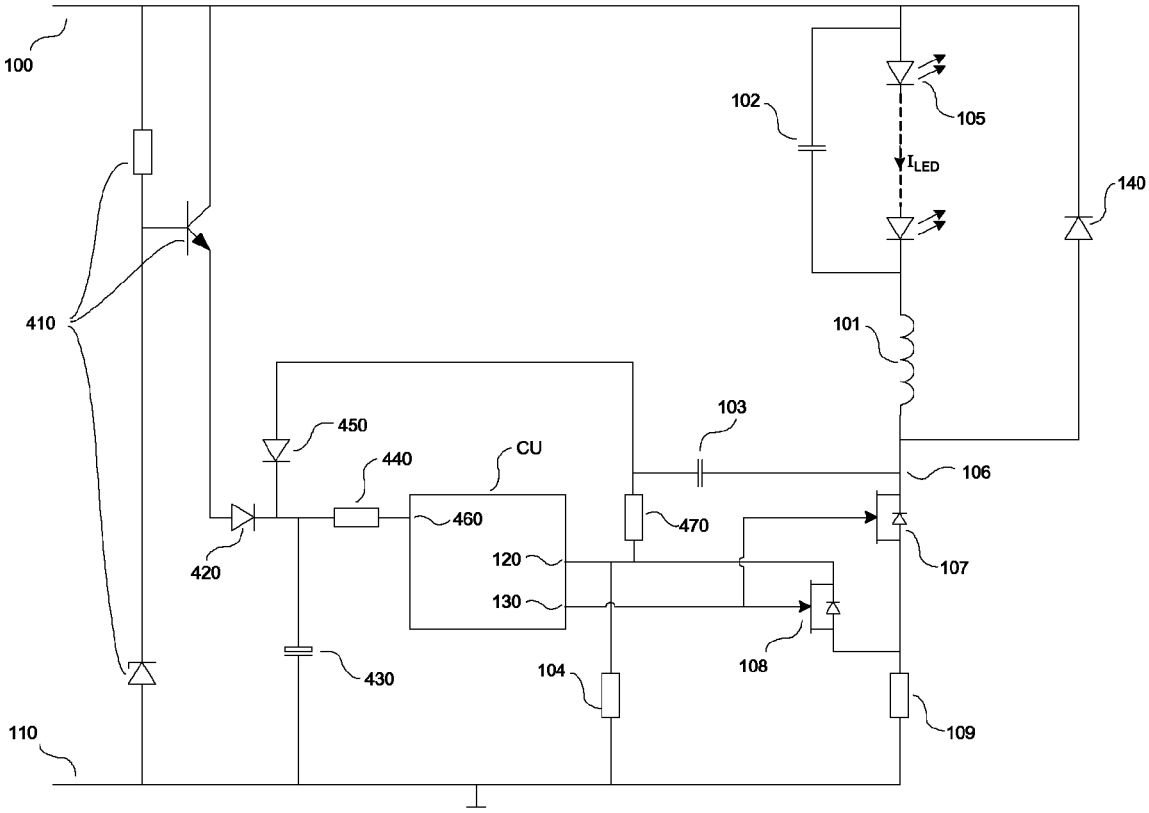
FIG. 4 schematically depicts an LED based lighting application powered by a second embodiment of an LED driver according to the invention.

In FIG. 4, an LED based lighting application powered by a second embodiment of an LED driver according to the invention is shown. Compared to the embodiment as shown in FIG. 1, the inductance 101 is no longer directly coupled to the supply voltage 100, rather, the inductance is coupled between the second terminal 106 and the LED fixture. As such, in the embodiment as shown, the capacitance 102 and the LED fixture (comprising the array of LEDs 105) are connected to the second terminal 106 via an inductance 101 of the SMPS. In such an embodiment, the LED fixture can, in use, be directly coupled to the supply voltage 100, the supply voltage connection 100 thus acting as the first terminal. It has been devised by the inventors that the application of the inductance 101 downstream of the LED fixture can enable a reduction of EMC.

In the embodiment as shown in FIG. 1, the supply of the control unit CU could e.g. be delivered via capacitor 103 and a protection diode as is in general available inside the control unit CU at pin 120. Supplying the control unit In this way may enable a better efficiency.

In FIG. 4, an alternative way of supplying the control unit is shown by providing a contribution path for the supply outside of the CU. This manner of supplying the control unit has been found to have less influence on the internal reference voltage. In order to realise this, a so called "dV/dt supply" is applied in FIG. 4 for facilitating the supply of the control unit. Compared to the circuit as shown in FIG. 1, such a dV/dt supply is added in FIG. 4, while re-using capacitance 103. The operation of the dV/dt supply can be understood as follows: Each time the voltage at 106 rises, the voltage at input terminal 120 is pulled up via capacitor 103 but also capacitor 430 is charged via diode 450. By adding an impedance 470, the voltage to which capacitor 430 can be charged can be higher than the necessary supply voltage of control unit CU. In this way a voltage margin at the supply 460 of the control unit can be created. This may be necessary for CU's that deploy a shunt regulator internally to regulate the supply voltage. To allow this regulation, an impedance 440 can be added. To start-up the circuit, the initial supply voltage for the CU can e.g. obtained from linear regulator 410. Preferably, the regulator 410 should be dimensioned to deliver a somewhat lower supply voltage to capacitance 430, in order to ensure that when the circuit via capacitor 103 and diode 450 takes over, the diode 420 will block.

Figure 5:
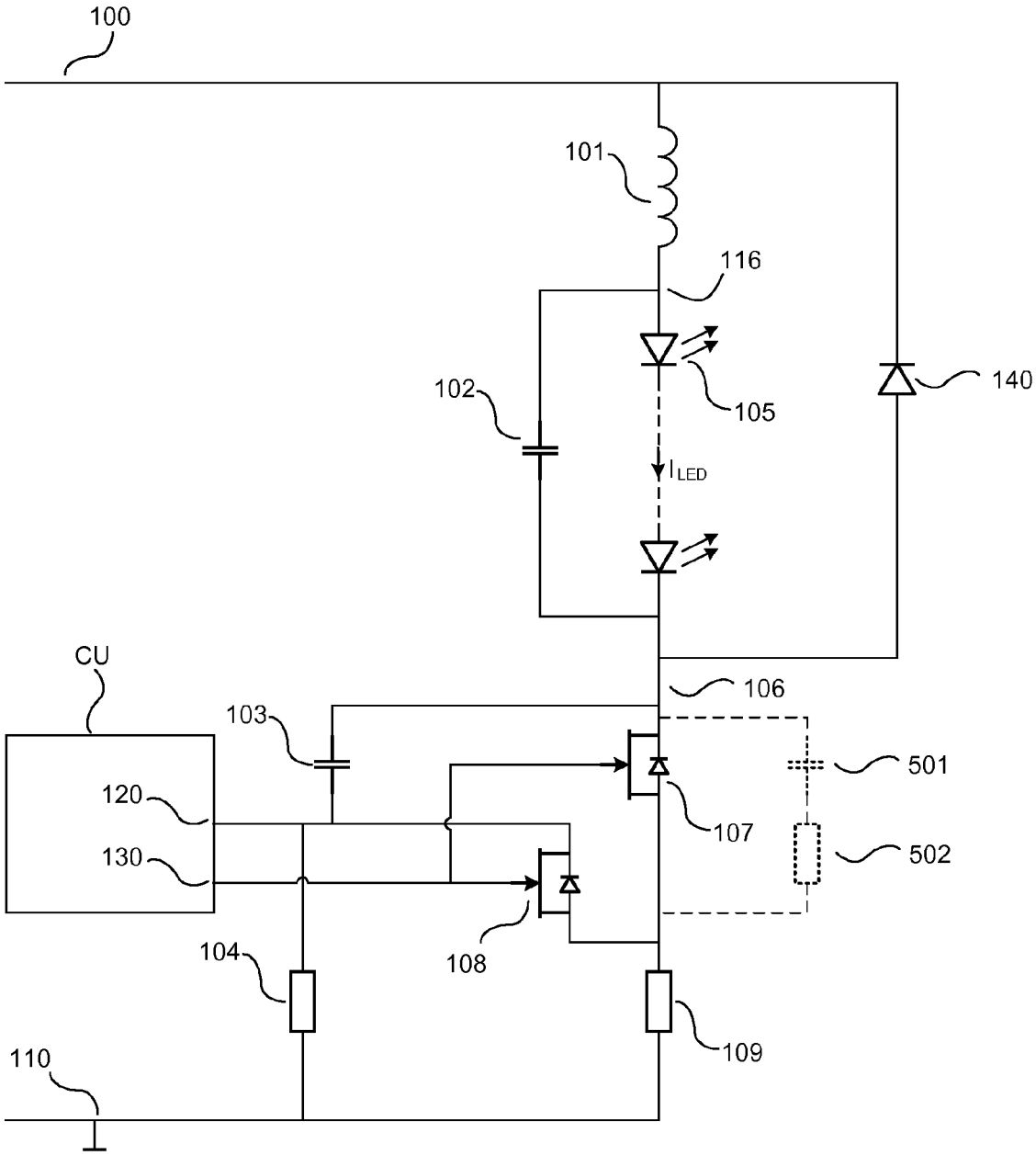
FIG. 5 schematically depicts an LED based lighting application powered by a first embodiment of an LED driver according to the invention, including a dV/dt control.

In FIG. 5, a similar arrangement as shown in FIG. 1 is schematically depicted including a dV/dt control of the switch 107. Electronic switches such as FETs are often bridged with a capacitor either directly or in series with a resistor, to lower the dV/dt of its drain-source voltage, as depicted in FIG. 5 by capacitor 501 and resistor 502. Using the current sensing circuit as proposed however, dV/dt can also be lowered by suitable dimensioning of capacitor 103 and resistor 104.

Figure 6:
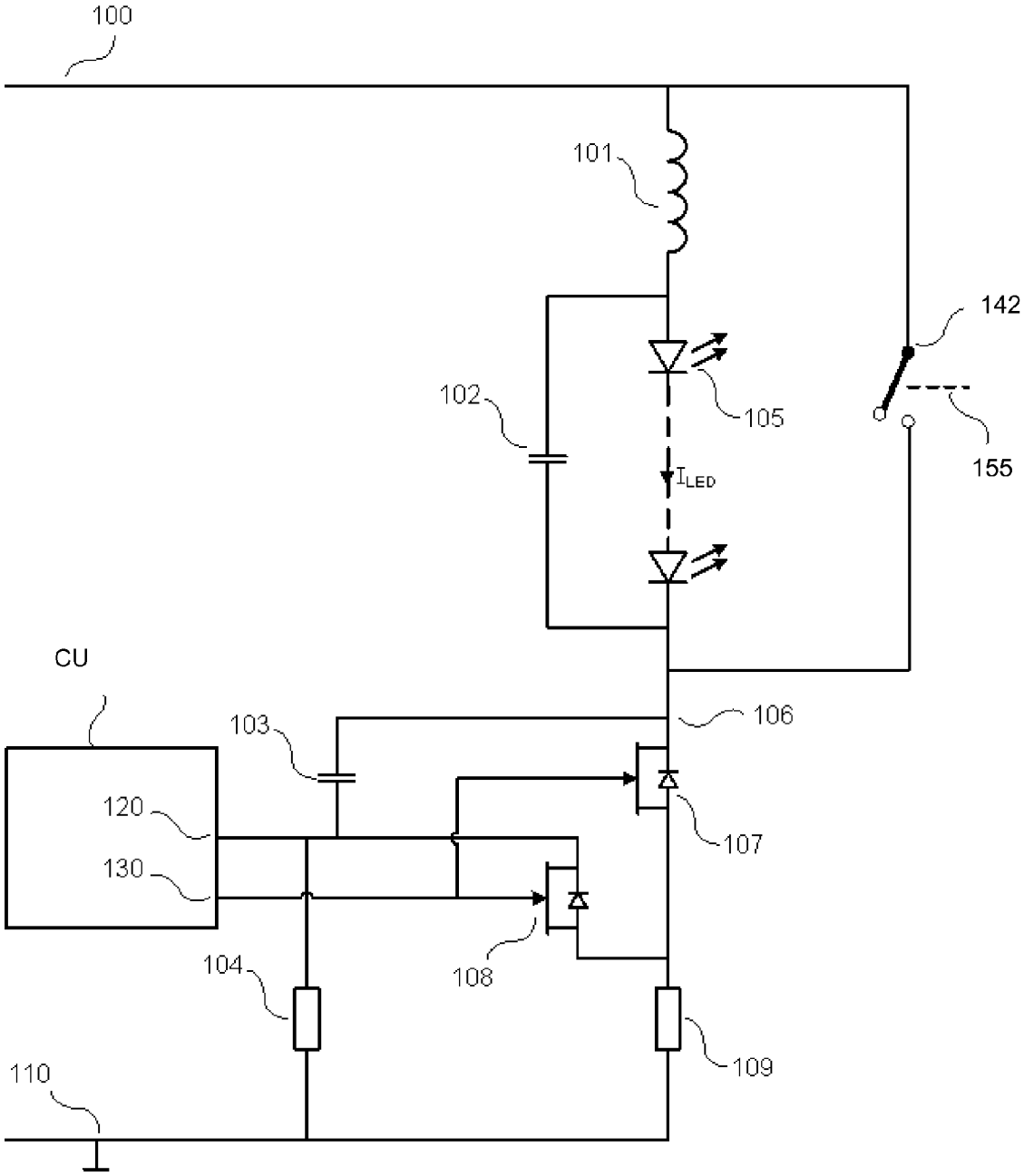
FIG. 6 schematically depicts an LED based lighting application powered by a third embodiment of an LED driver according to the invention.

In FIG. 6, a similar embodiment as shown in FIG. 1 is schematically depicted. In the embodiment as shown, the first capacitance 102 and the LED fixture are, as in FIG. 1, arranged between the first terminal 116 and the second terminal 106. In the embodiment as shown, the SMPS comprises a freewheeling switch 142 instead of the freewheeling diode 140 as shown in FIG. 1 for providing a freewheeling current path when the switch 107 is open. In an embodiment, the freewheeling switch (e.g. a FET or MOSFET) is controlled by a control signal 155, e.g. provided by the control unit CU. The control unit CU can e.g. control the freewheeling switch 155 to close when switch 107 is opened and vice versa.

Figure 7:
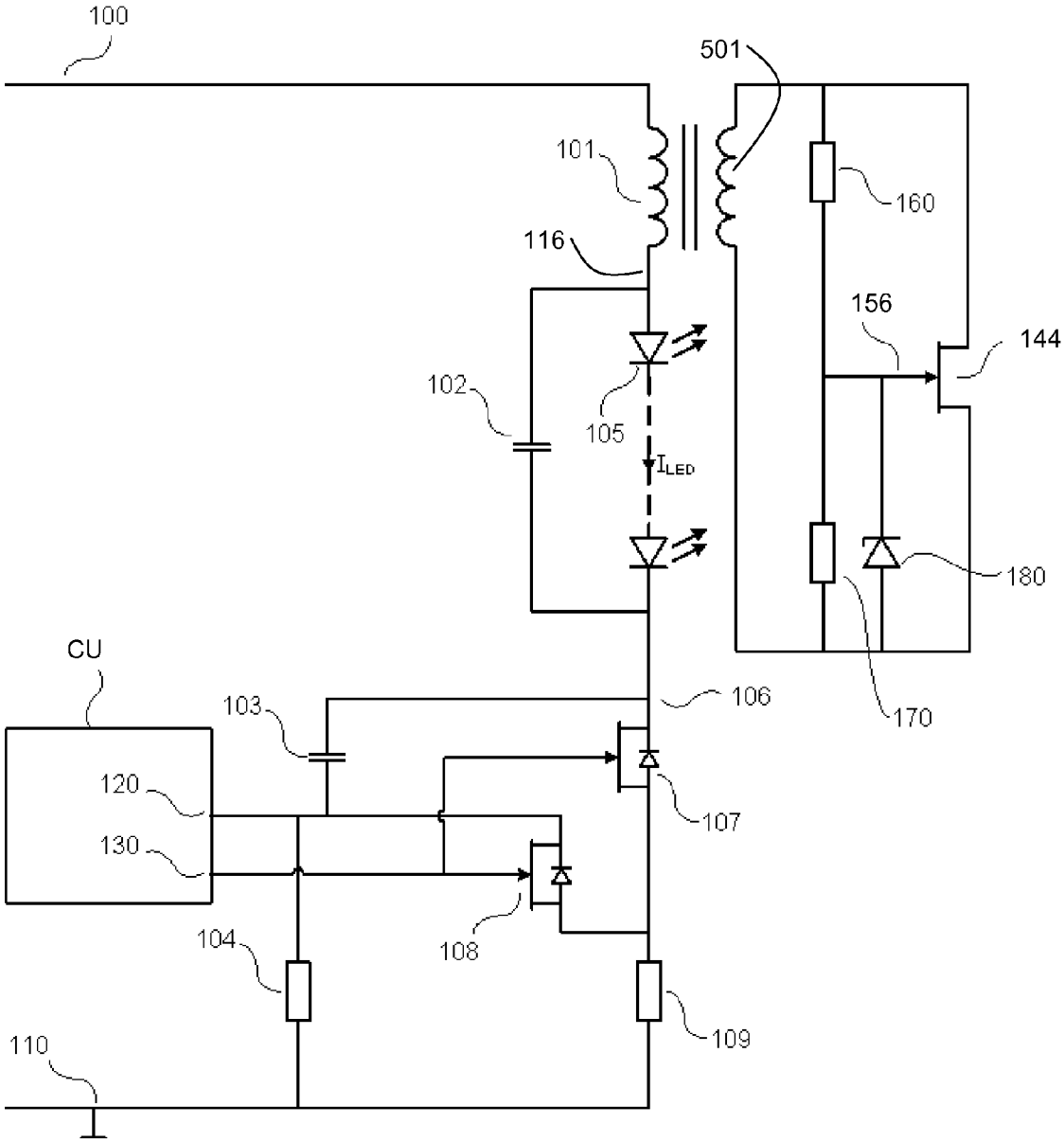
FIG. 7 schematically depicts an LED based lighting application powered by a fourth embodiment of an LED driver according to the invention.

In FIG. 7, yet another embodiment of the LED driver according to the invention is shown wherein yet another alternative arrangement of the freewheeling path of the SMPS is shown. In the arrangement as shown, the freewheeling path is controlled by a switch 144 which receives its control signal 156 via voltage divider 160/170 and inductance 501 that is magnetically coupled to inductance 101 of the SMPS. Also in this arrangement, the first capacitance 102 and the LED fixture are arranged between terminals 116 (in use operating at a comparatively high voltage) and 106.

Figure 8:
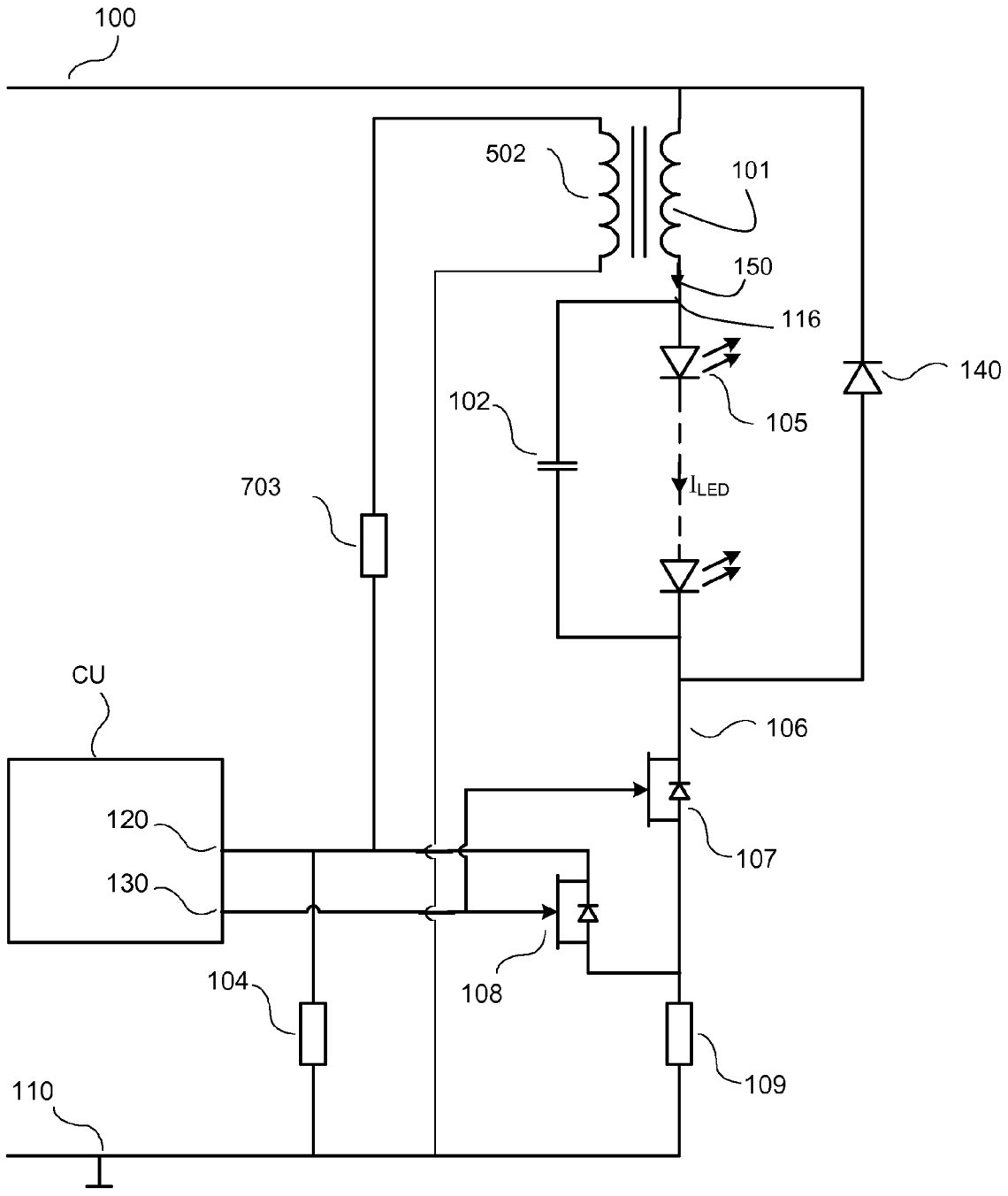
FIG. 8 schematically depicts an LED based lighting application powered by a fifth embodiment of an LED driver according to the invention.

In FIG. 8, yet another embodiment of the LED driver according to the invention is shown comprising an alternative arrangement for providing the feedback signal when switch 107 is open. Compared to the arrangements shown in FIGS. 1, 4-7 (wherein the feedback signal is provided via capacitance 103), the feedback signal is derived from an inductance 502 that is magnetically coupled to inductance 101 of the SMPS. The inductance 502 is connected to the ground terminal 110 and to the input terminal 120 (via resistance 703). A voltage induced in the inductance 502 can thus be provided to the terminal 120 via resistance 703. Based on the feedback signal, the control unit CU can derive if the current 150 through the inductance 101 is high enough, in a similar manner as explained in FIG. 2. Note that, in the arrangement as shown in FIG. 8, the feedback signal as provided via the resistance 703 remains available even when switch 107 is open.

Figure 9:
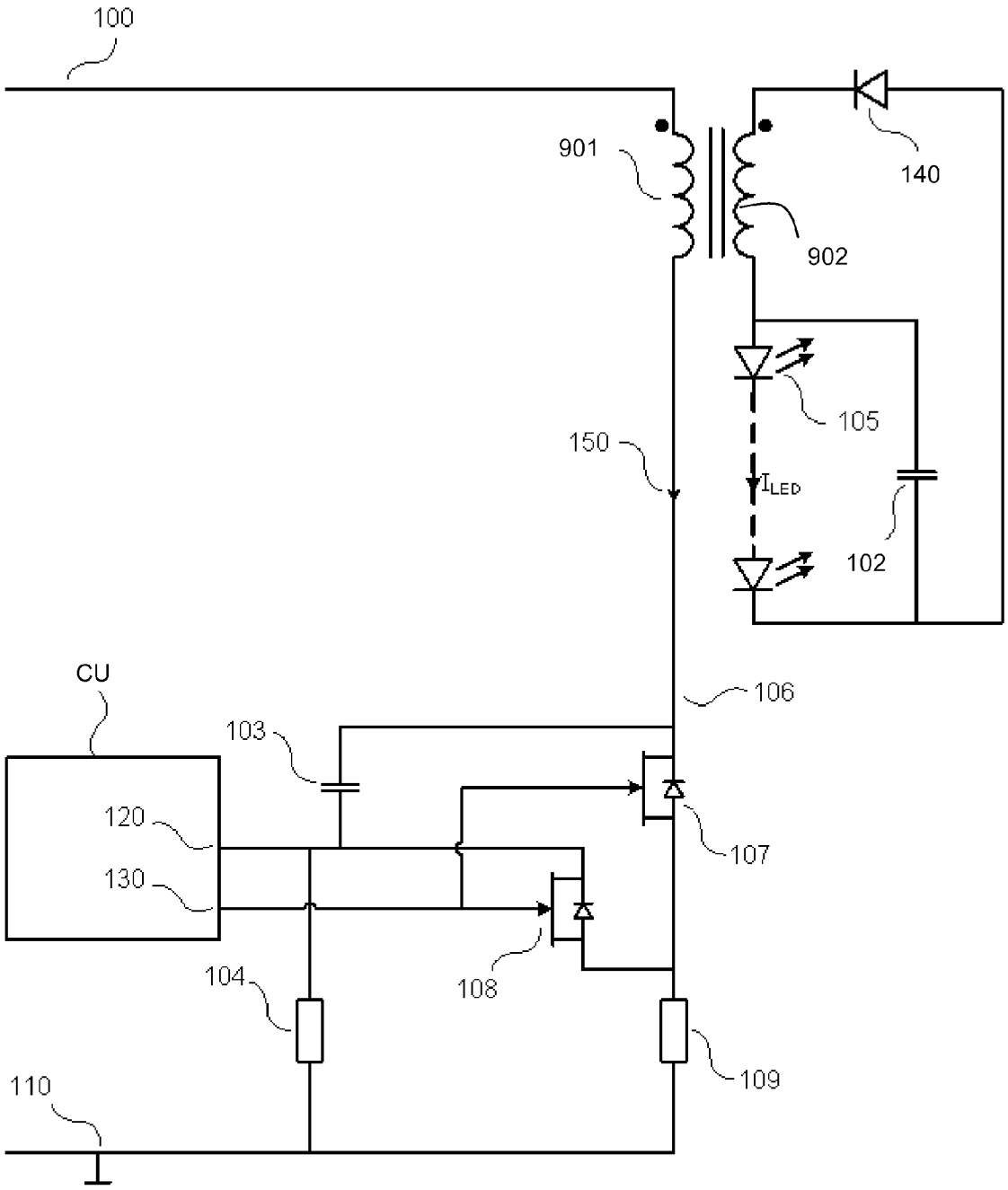
FIG. 9 schematically depicts an LED based lighting application powered by a sixth embodiment of an LED driver according to the invention.

In FIG. 9, a further embodiment of the LED driver according to the invention is schematically shown, wherein the SMPS comprises a flyback circuit. In such an arrangement, the LED fixture is connected between the first and second terminals 100, 106 via a transformer formed by the magnetically coupled inductances 901, 902 forming the primary and secondary windings of the transformer. As shown, the LED fixture 105 is thus provided in a secondary circuit of the transformer, together with the capacitance 102 and diode 140. With respect to providing a feedback signal to terminal 120, the arrangement as shown in FIG. 9 is similar to the arrangement of FIG. 1,5,6 or 7, wherein a second capacitance 103 is used for providing a feedback signal from the second, low voltage terminal 106 to input terminal 120.

With respect to the embodiments shown, it can be noted that the arrangement of the freewheeling switch as schematically shown in FIGS. 6 and 7 may also be applied in FIG. 8 or 9 as an alternative to the application of freewheeling diode 140.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The invention claimed is:

1. An LED driver for providing a current to an LED fixture comprising at least one LED, the LED driver comprising:

a switched mode power supply (SMPS) for providing the current to the LED fixture, the SMPS comprising a first, high voltage terminal and a second, low voltage terminal for, in use, receiving the LED fixture; the SMPS comprising a first capacitance for, in use, bridging the LED fixture, and a switch, connected at the second terminal, downstream of the LED fixture;

a control unit for controlling the switch of the SMPS based on a feedback signal received at an input terminal of the control unit;

a current sensing circuit arranged to provide the feedback signal to the input terminal of the control unit; the current sensing circuit being arranged to provide the feedback signal to the input terminal when the switch is open; the current sensing circuit further comprising a current sensor arranged to provide, when the switch is closed, the feedback signal representing a level of the current supplied to the LED fixture, by connecting the current sensor to the input terminal via a further switch, the further switch being controlled by the control unit.

2. The LED driver according to claim 1 wherein the current sensing circuit comprises a second capacitance connecting the second terminal and the input terminal for providing the feedback signal when the switch is open.

3. The LED driver according to claim 1 wherein the first terminal in use is connected to a supply voltage via an inductance of the SMPS.

4. The LED driver according to claim 3 further comprising a freewheeling switch in a freewheeling current path of the SMPS.

5. The LED driver according to claim 4, further comprising a further inductance magnetically coupled to the inductance of the SMPS for controlling the freewheeling switch.

6. The LED driver according to claim 3 wherein the current sensing circuit comprises a further inductance that is magnetically coupled to the inductance for providing the feedback signal when the switch is open.

7. The LED driver according to claim 1 wherein the first capacitance and the LED fixture are, in use, connected to the second terminal via an inductance of the SMPS.

8. The LED driver according to claim 7 further comprising a freewheeling switch in a freewheeling current path of the SMPS.

9. The LED driver according to claim 8, further comprising a further inductance magnetically coupled to the inductance of the SMPS for controlling the freewheeling switch.

10. The LED driver according to claim 1 wherein the switch and the further switch are controlled in synchronism.

11. The LED driver according to claim 1 wherein a control terminal of the switch and a control terminal of the further switch are connected to a single output terminal of the control unit for receiving a control signal.

12. The LED driver according to claim 1 further comprising a freewheeling diode in a freewheeling current path of the SMPS.

13. The LED driver according to claim 1 further comprising a freewheeling switch in a freewheeling current path of the SMPS.

14. The LED driver according to claim 13 wherein the freewheeling switch is controlled by the control unit based on the feedback signal.

15. The LED driver according to claim 1 wherein the current sensor is provided in series with the switch, outside a freewheeling current path of the SMPS.

16. The LED driver according to claim 1 wherein the SMPS comprises a transformer having a primary winding connected between the first and second terminal and a secondary winding for in use receiving the LED fixture.

17. The LED driver according to claim 1 wherein the control unit is arranged to operate the SMPS in boundary condition mode (BCM) or discontinuous mode based on the feedback signal.

18. An LED based lighting application comprising an LED fixture comprising one or more LEDs and an LED driver according to claim 1 for providing a current to the LED fixture.

* * * * *